US006057532A

United States Patent [19]

Dexter et al.

[11] Patent Number: 6,057,532

[45] Date of Patent: May 2, 2000

[54] INFRA-RED RADIATION SOURCES

[76] Inventors: Amos Christopher Dexter, 30 Bendee Road, Little Neston, South Wirral, L64 9QG; William Jones, 10 swn-Y-Nant, Upper Bryn coch, Mould, Clywd, CH7 1XL, both of United Kingdom

[21] Appl. No.: 08/553,309

[22] PCT Filed: May 19, 1994

[86] PCT No.: PCT/GB94/01070

§ 371 Date: Mar. 15, 1996

§ 102(e) Date: Mar. 15, 1996

[87] PCT Pub. No.: WO94/28693

PCT Pub. Date: Dec. 8, 1994

[30] Foreign Application Priority Data

May 21, 1993 [GB] United Kingdom ..... 9310499

[51] Int. Cl.[7] ..... H05B 3/10; H01J 5/50

[52] U.S. Cl. ..... 219/553; 313/331

[58] Field of Search ..... 219/552, 553, 219/541, 542, 464, 465, 468; 313/315, 331, 332, 279

[56] References Cited

U.S. PATENT DOCUMENTS

| | | | |
|---|---|---|---|
| 2,864,025 | 12/1958 | Foote et al. | 313/315 |
| 2,910,605 | 10/1959 | Hodge | 313/315 |
| 3,538,374 | 11/1970 | Kane | 313/315 |
| 3,854,979 | 12/1974 | Rossi | 427/228 |
| 4,005,325 | 1/1977 | Suga | 313/311 |
| 4,048,394 | 9/1977 | Ludwig | 429/104 |
| 4,430,597 | 2/1984 | Thompson | 313/113 |
| 4,543,472 | 9/1985 | Arai et al. | 219/411 |
| 4,588,923 | 5/1986 | Hoegler et al. | 313/315 |
| 4,598,194 | 7/1986 | Halberstadt et al. | 219/464 |
| 4,774,396 | 9/1988 | Salit et al. | 219/553 |

FOREIGN PATENT DOCUMENTS

| | | |
|---|---|---|
| 1540750 | 9/1968 | France . |
| 110 614 | 7/1898 | German Dem. Rep. . |
| 129029 | 12/1977 | German Dem. Rep. . |
| 53-097283 | 8/1978 | Japan . |
| 53-102976 | 9/1978 | Japan . |
| 55-133751 | 10/1980 | Japan . |
| 905918 | 2/1982 | Russian Federation . |
| 1534554 | 1/1990 | U.S.S.R. . |
| 966177 | 8/1964 | United Kingdom . |
| WO 90/16137 | 12/1990 | WIPO . |

OTHER PUBLICATIONS

D O Newling and EJ Walker, "High Performance 'Graphitized' Carbon/Carbon Composites", Paper No. 37, pp. 142–153. Feb. 1971.

*Primary Examiner*—Teresa Walberg
*Assistant Examiner*—Sam Paik

[57] ABSTRACT

There is described an infra-red radiation source comprising an electrically conductive element (2) formed of a plurality of carbon fibres and connection means (3, 4, 5) for connecting the electrically conductive element (2) across an electrical power supply, said connection means (3, 4, 5) including at least one support member (3) formed of carbon and secured to one end of the electrically conductive element (2).

40 Claims, 9 Drawing Sheets

INFRA-RED RADIATION SOURCES

The present invention relates to infra-red radiation sources and in particular to those sources comprising an electrically conductive element formed of a plurality of carbon fibres.

Infra-red radiation sources are used as heat sources in commercial process ovens, domestic cooker hot plates and ovens, and radiant energy electrical heaters.

In each of the aforementioned applications there is a requirement for a higher degree of control of the heat output by such sources. To attain this higher degree of control the heat output from the source should rapidly reach an equilibrium value for a predetermined and constant electrical power input. Furthermore, the electrical resistence of the source should not vary to any great extent as it heats from room temperature to its maximum operating temperature. It is also desired that the source be capable of operating effectively through a wide range of power outputs which in turn necessitates a wide range of element temperatures such as, for example, between 600° C. and 1800° C.

There is in addition a further requirement for the processing of varied pigmented surfaces such that the source should have an enhanced emissivity at wavelengths much longer than those of the visible spectrum.

In the past a number of designs of infra-red radiation source have been proposed in which various starting materials are used for forming the or each electrically conductive element. Most of these starting materials have, after processing, yielded brittle elements which are difficult to handle. It has been found however that the use of carbon fibre fabrics and linear tapes impregnated with certain resins and thermoplastics such as epoxy allow the fabrication of elements having the required degree of flexibility.

Within the designs that use carbon fibre the or each carbon fibre element is supported at opposite ends between two members which are adapted so as to facilitate the connection of the element across an electrical power supply. Typically these supporting members have been formed of metals such as tungsten, molybdenum, nickel or steel. However, one of the problems associated with carbon fibre infra-red radiation sources is the tendency for the element to become sufficiently degraded within the region of the metal supporting members as to result in the failure of the radiation source after only a few tens of hours of operation. This degradation comes about as a result of either migration of carbon atoms from the conductive element into the metal of the or each supporting member or as a result of a reaction between the carbon and the metal to form the apropriate metal carbide. In either event carbon atoms are removed from the element resulting in its eventual collapse. As the carbon atoms are removed there is a tendency for the temperature of the element to increase which in turn only serves to exacerbate the mechanisms by which the carbon is lost.

According to a first aspect of the present invention there is provided an infra-red radiation source comprising an electrically conductive element formed of a plurality of carbon fibres and connection means for connecting the electrically conductive element across an electrical power supply, the connection means including at least one support member formed of carbon and secured to one end of the electrically conductive element.

According to a second aspect of the present invention there is provided an infra-red radiation source comprising an electrically conductive element formed of a plurality of carbon fibres and connection means for connecting the electrically conductive element across an electrical power supply, said connection means including at least one support member secured to one end of the electrically conductive element and formed of or coated with a metal through which carbon does not diffuse.

According to a third aspect of the present invention there is provided an infra-red radiation source comprising a housing formed of a material transparent to infra-red radiation, an electrically conductive element located within the housing and formed of a plurality of carbon fibres, connection means for connecting the electrically conductive element across an electrical power supply and restraining means for limiting unwanted movement of the conductive element with respect to the housing.

According to a fourth aspect of the present invention there is provided a method of making an infra-red radiation source comprising the steps of forming an electrically conductive element from a plurality of carbon-fibres, securing to at least one end of the electrically conductive element a support member formed of carbon and connecting to the support member means for connecting the electrically conductive element across an electrical power supply.

According to a fifth aspect of the present invention there is provided a method of making an infra-red radiation source comprising the steps of forming an electrically conductive element from a plurality of carbon-fibres, securing to at least one end of the electrically conductive element a support member formed of a material through which carbon does not diffuse, and connecting to the support member means for connecting the electrically conductive element across an electrical power supply.

According to a sixth aspect of the present invention there is provided a method of making an infra-red radiation source comprising the steps of forming an electrically conductive element of a plurality of carbon fibres, disposing the electrically conductive element within a housing formed of a material transparent to infra-red radiation, providing the electrically conductive element with means to limit unwanted movement of the electrically conductive element with respect to the housing and securing to the electrically conductive element means for connecting the electrically conductive element across an electrical power supply.

A number of embodiments of the present invention will now be described by way of example with reference to the accompanying drawings in which.

Figure 1:
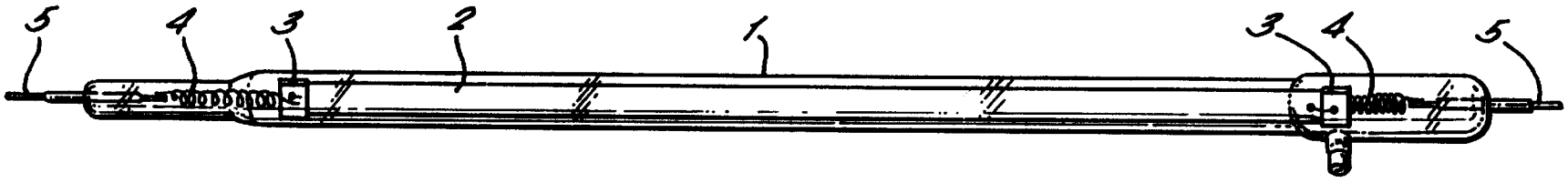
FIG. 1 is a schematic perspective view of an infra-red radiation source.

Referring to FIG. 1 the infra-red radiation source may be seen to comprise a tube 1 of material which is transparent to infra-red radiation, such as for example a ceramic material such as quarzglas or fused silica. The tube 1 contains an electrically conductive element 2 in the form of a flat or coiled strip formed of carbon fibres which are coated with and bonded by the carbon residue of a carbonised resin. At each end of the strip 2 there is provided a respective one of two connectors 3 which are both mechanically and electrically connected to the strip 2. Each connector 3 is connected to a respective electrical conductor 4 which is in turn connected to a respective electrical feed through lead 5 which passes through an otherwise closed end of the tube 1. The electrical feed through leads 5 are adapted so as to be connectable across a suitable electrical power supply such that in use the strip 2 may be caused to emit infra-red radiation.

Turning now to a more detailed consideration of the connectors 3 by which the electrically conductive element 2 is connected to the electrical conductors 4, in a first embodiment the or each connector 3 is formed of a metal, such as copper, through which carbon does not diffuse or of a metal coated with another metal through which carbon does not diffuse. In such an arrangement the metal connectors 3 may be either alloyed or coated with a material that will both wet the surface of the carbon fibres of the strip 2 and provide a good electrical contact between the strip and the or each connector 3. One way in which this might be achieved for a copper connector is to alloy the copper with 1% chromium. Another example of a metal that is capable of wetting both copper and the carbon fibres of the electrically conductive element is gold which may thus be used at an interface between the two materials. Irrespective of the metal coating that is used the coating may be applied to the ends of the electrically conductive element 2 either by an electroplating process or by the application of a metal based paint which is subsequently heated to drive off the solvent and/or organic carrier to leave the metal deposit.

Figure 2:
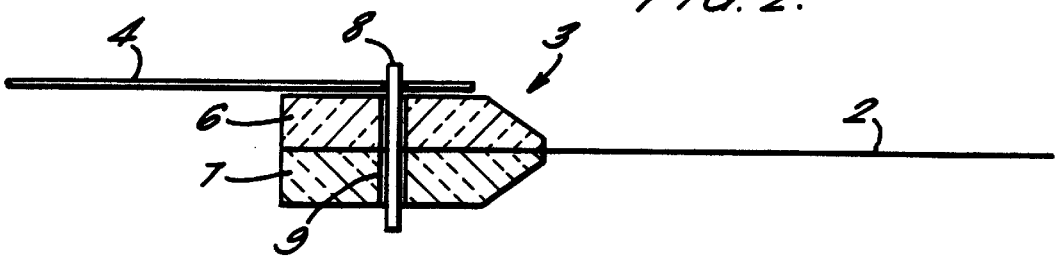
FIG. 2 is a cross-sectional side view of a support member for use in conjunction with one embodiment of the present invention.
Figure 3:
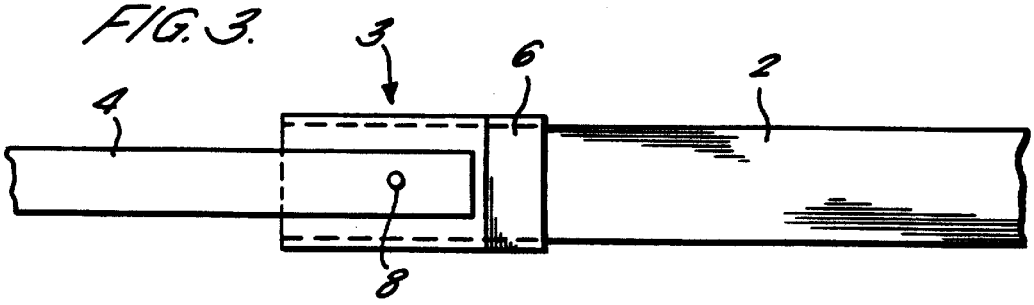
FIG. 3 is a plan view of the support member of FIG. 2.

In a second embodiment shown in FIGS. 2 and 3 the or each connector 3 comprises a pair of carbon blocks 6,7 disposed on either side of the electrically conductive element 2 and which are secured together so as to retain the element therebetween. By pressing the two carbon blocks 6 and 7 together it is possible to form a carbon-carbon compression bond between the blocks and the carbon fibres of the strip 2. If, in addition, the blocks 6,7 and the strip 2 are both heated whilst being pressed together then additional bonding may occur as a result of the melting and subsequent carbonising of the carbon-based resin used to coat the carbon fibres in either event the increased thickness of carbon at the or each connector 3 when compared with the central region of the strip 2 provides the two fold advantage of reducing the heat generated within the vicinity of and conducted to the electrical conductors 4 whilst at the same time providing additional strength for mechanical connection.

In the embodiment shown in FIGS. 2 and 3 this mechanical connection is provided by means of a nut and bolt or rivet 8 which passes through a through-bore 9 provided in each of the carbon blocks 6,7 and which extends in a direction substantially perpendicular to the plane of the carbon fibre strip 2. The nut and bolt or rivet 8 serves to secure the connector 3 to its respective electrical conductor 4 which, in the example shown, is formed of molybdenum. Molybdenum is preferred for the formation of both the electrical conductors 4 and the feed through leads 5 for a number of reasons. Firstly, molybdenum is a non-ferrous, refractory metal that does not stress relieve at temperatures below 1000° C. while secondly molybdenum is less able than, say, nickel or stainless steel, to catalyse those reactions that are damaging to the carbon of the electrically conductive element.

Figure 4:
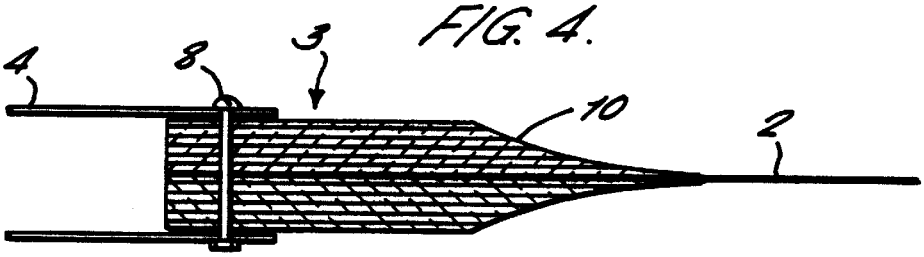
FIG. 4 is a cross-sectional side view of a support member for use in conjunction with another embodiment of the present invention.
Figure 5:
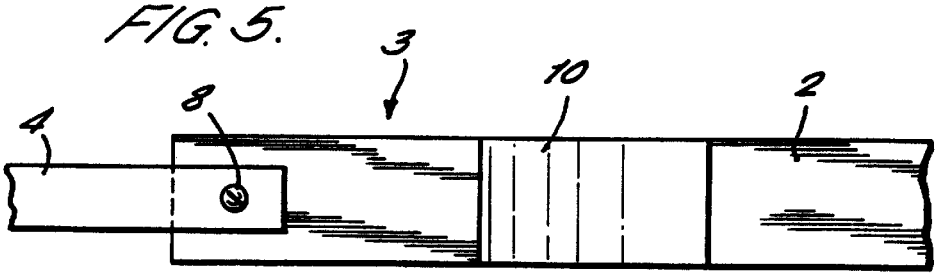
FIG. 5 is a plan view of the support member of FIG. 4.

In a third embodiment shown in FIGS. 4 and 5 the or each connector 3 is formed of a plurality of carbon fibre layers 10 which are laid one on top of the other and then carbonised to form an end portion of the elctrically conductive element 2 of increased thickness. As in the embodiment previously described, the or each connector 3 may be secured to its respective electrical conductor 4 by means of a nut and bolt or rivet 8 although it is to be noted that as in the embodiment illustrated the electrical conductor 4 may comprise two mutually spaced parallel strips each of which is attached to an opposing surface of the connector 3. As in the previous embodiment, the or each electrical conductor 4 is preferably formed of molybdenum.

Figure 6:
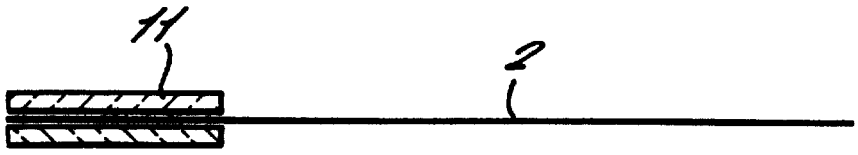
FIG. 6 is a cross-sectional side view of a support member for use in conjunction with another embodiment of the present invention.
Figure 7:
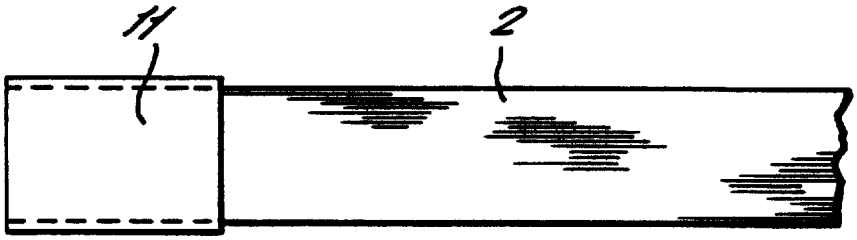
FIG. 7 is a plan view of the support member of FIG. 6.

In a fourth embodiment shown in FIGS. 6 and 7 the or each connector 3 may comprise a quantity of graphite paper which is disposed by wrapping or otherwise so as to lie adjacent opposing surfaces of the carbon fibre strip 2 and form a graphite pad 11. The graphite paper is preferably a crushable tape typically 1 mm in thickness and which is made primarily of graphite (99% carbon). One such tape is sold by Le Carbonne under their product reference Papyex H995 SR.

In order to form the or each graphite pad 11 and graphite paper is cut so as to have a width substantially equal to that of the carbon fibre strip 2 whilst at the same time having a length of approximately 20 mm. The cut lengths of graphite paper are then adhered to opposing surfaces of the carbon fibre strip at each end by means of a double sided adhesive tape. One such tape suitable for this purpose comprises a 0.1 mm thick polypropelene tape coated on both sides with a synthetic rubber adhesive. Once the graphite paper has been adhered to each end of the electrically conductive element the ends are heated to a temperature of approximately 500° C. and a light pressure applied to the graphite paper for about one minute. During this process the polypropelene tape partially decomposes and the carbon-based resin used to coat the carbon fibres of the conductive element melts to form a strong uniform bond with the graphite paper on cooling. The resulting graphite pads act as a buffer to prevent the loss of carbon from the electrically conductive element in the vicinity of the or each electrical conductor 4 by means of diffusion or arcing.

Having formed the or each graphite pad 11 in the manner described, the graphite pad may be connected to its respective electrical conductor 4 in a variety of ways.

Figure 8:
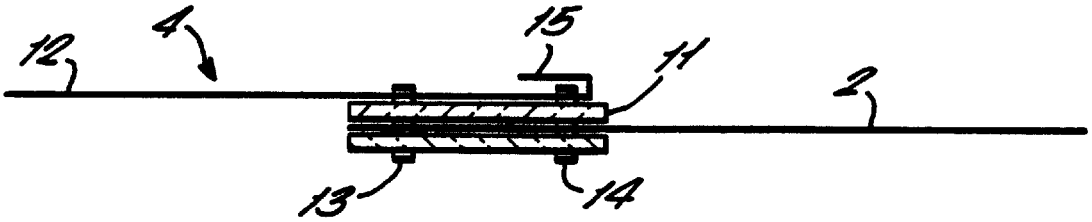
FIG. 8 is a cross-sectional side view of a first arrangement whereby the support member of FIG. 6 is attached to an electrical conductor.
Figure 9:
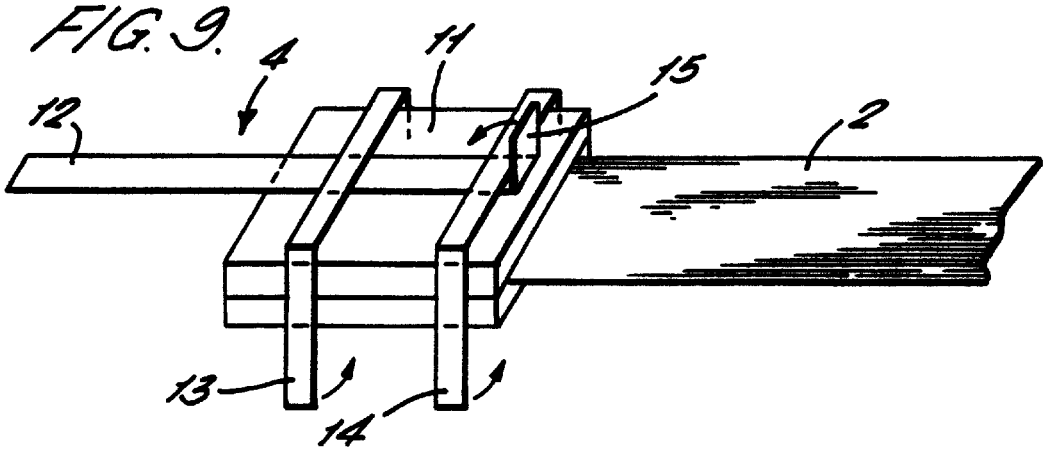
FIG. 9 is a schematic perspective view of the arrangement of FIG. 8.

One such method of attachment is shown in FIGS. 8 and 9 to comprise a molybdenum strip 112 which is arranged so as to overlie the graphite pad 11 and extend in a direction substantially parallel to the carbon fibre strip 2. Two molybdenum straps 13 and 14 are then arranged so as to overlie and extend in a direction transverse to the molybdenum strip 12, the molybdenum straps 13,14 being of sufficient length so as to be capable of being folded first down the sides and then underneath the graphite pad 11. By overlying the molybdenum strip 12 the molybdenum straps 13 and 14 serve to retain the molybdenum strip in contact with the graphite pad however, for added security an end portion 15 of the molybdenum strip 12 adjacent the electrically conductive element 2 may be folded back on itself to overlie and engage one or both of the molybdenum straps 13,14. Finally, the molybdenum strip 12 and molybdenum straps 13 and 14 are crushed into the graphite pad 11 to provide good electrical contact and a reliable mechanical connection between the pad and the electrical conductor 4.

Figure 10:
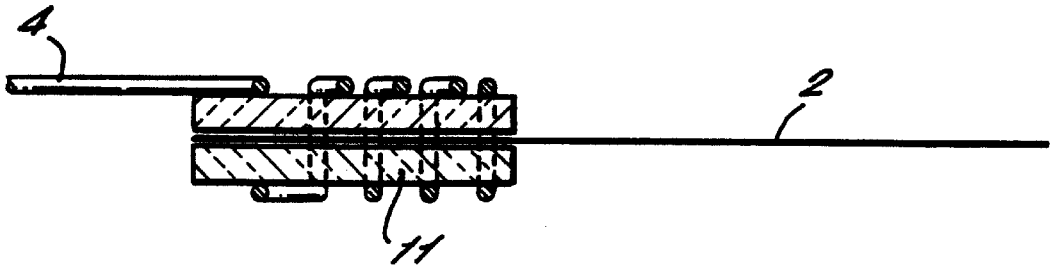
FIG. 10 is a cross-sectional side view of a second arrangement whereby the support member of FIG. 6 is attached to an electrical conductor.
Figure 11:
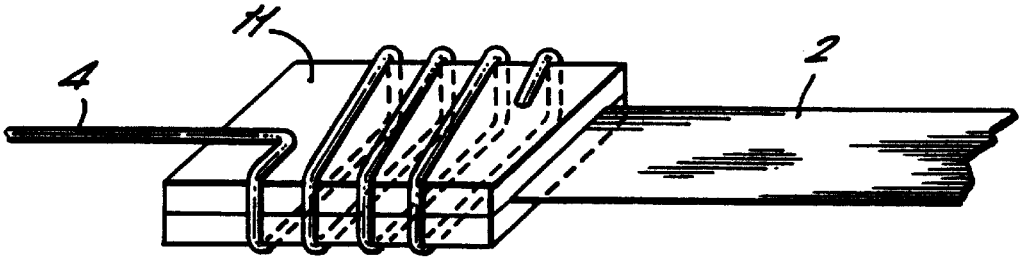
FIG. 11 is a schematic perspective view of the arrangement of FIG. 10.

In a second arrangement which is illustrated in FIGS. 10 and 11 the electrical conductor 4 is formed of a length of molybdenum wire which is wrapped around the graphite pad 11 in a spiral. As in the previous arrangement the molybdenum wire is then crushed into the graphite pad to ensure a reliable electrical contact and a good mechanical connection.

Figure 12:
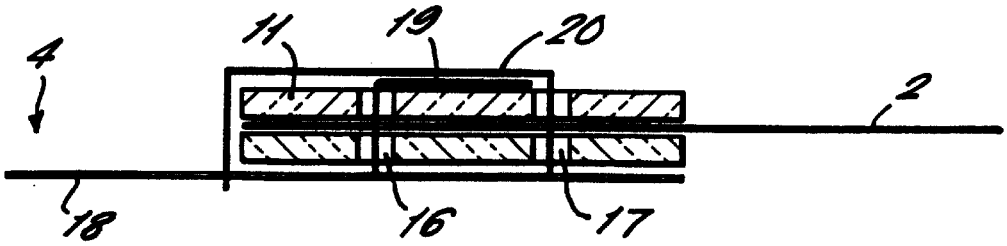
FIG. 12 is a cross-sectional side view of a third arrangement whereby the support member of FIG. 6 is attached to an electrical conductor.
Figure 13:
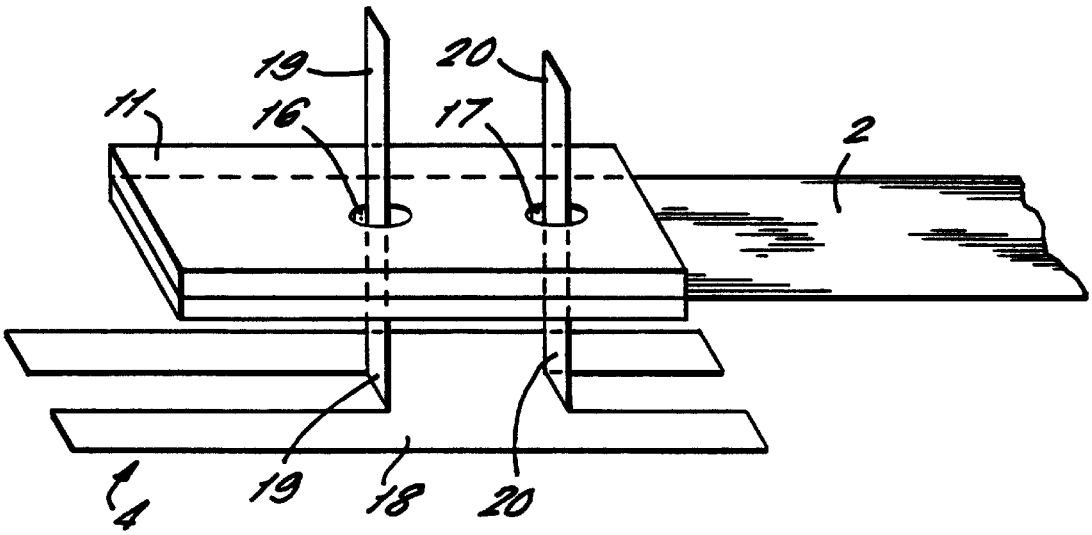
FIG. 13 is a shcematic perspective view of the arrangement of FIG. 12.

In a third arrangement shown in FIGS. 12 and 13 the graphite pad 11 is provided with a pair of mutually spaced through bores 16 and 17 each of which has a through-axis that extends in a direction substantially perpendicular to the plane of the carbon fibre strip 2. In this arrangement the electrical connector 4 comprises a rectangular molybdenum plate 18 which is provided along each of its shorter sides with a pair of mutually spaced, parallel cuts that extend longitudinally of the plate. These two pairs of cuts serve to define two fingers 19 and 20 that may be folded out of the plane of the molybdenum plate 18 so as to project substantially perpendicularly therefrom. In this configuration which is shown in FIG. 13 the graphite pad 11 may be received by the molybdenum plate 18 in such a way that each of the fingers 19 and 20 is received by and projects through a respective one of the two through-bores 16 and 17. Having been received in this way the two fingers 19 and 20 may be folded so that that portion of the fingers which project from the through-bores 16 and 17 is caused to overlie the surface of the graphite pad 11 which is opposed to that which lies adjacent the molybdenum plate 18. One such folded arrangement is shown in FIG. 12.

As with the other arrangements involving the use of one or more graphite pads, the molybdenum plate 18 and the now folded fingers 19 and 20 may be compressed into the graphite pad 11 to ensure reliable electrical contact and a secure mechanical connection.

Figure 14:
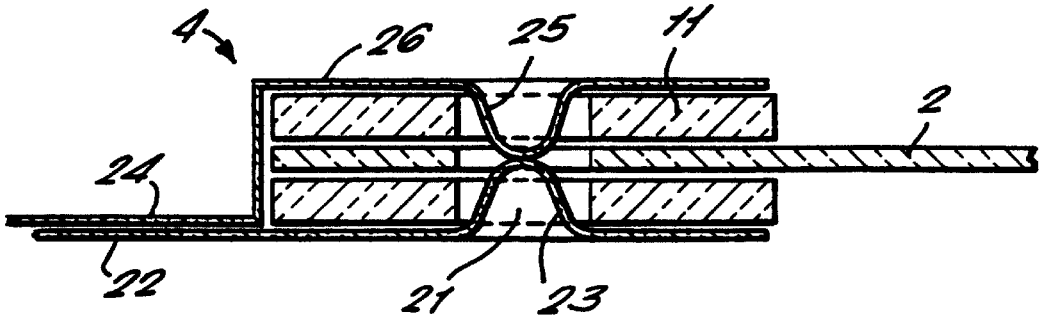
FIG. 14 is a cross-sectional side view of a fourth arrangement whereby the support member of FIG. 6 is attached to an electrical conductor.
Figure 15:
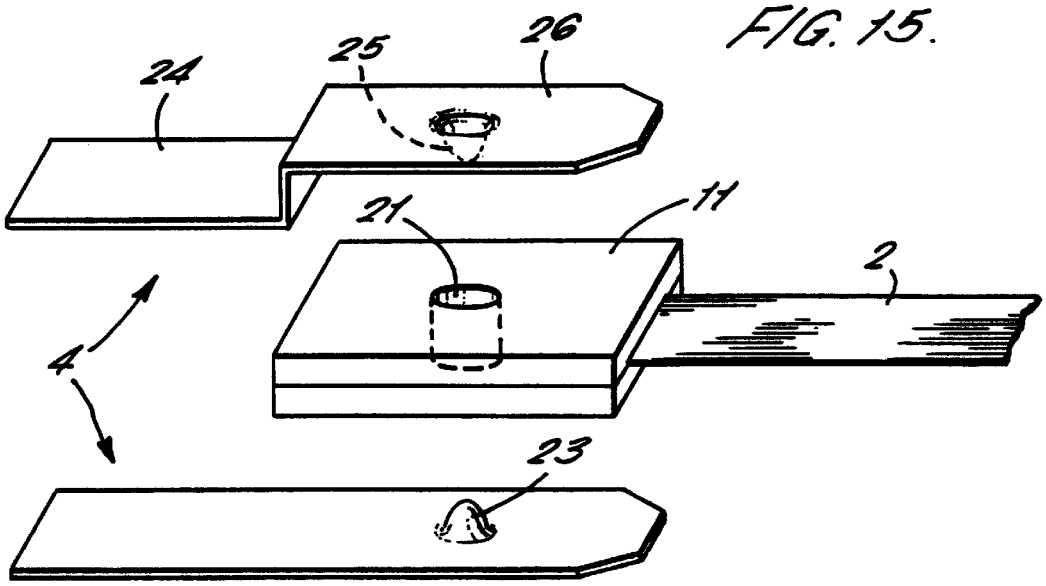
FIG. 15 is an exploded perspective view of the arrangement of FIG. 14.

In another arrangement shown in FIGS. 14 and 15 the graphite pad 11 may again be provided with a through-bore 21 having a through-axis which extends substantially perpendicularly to the plane of the carbon fibre strip 2. In this arrangement the electrical conductor 4 may comprise a first substantially planar member 22 having a projecting boss 23 disposed toward one end of the member and a second stepped member 24 having a depending boss 25 located on an under surface of a stepped portion 26.

In order to secure the graphite pad 11 to the electrical conductor 4 the graphite pad is first positioned on the substantially planar member 22 in such a way that the projecting boss 23 is received within the through-bore 21. Thereafter the stepped member 24 is positioned on top of the planar member 22 in such a way that the stepped portion 26 overlies the graphite pad 11 and the depending boss 25 is received within the through-bore 21. Once in this position the stepped member 24 may be secured to the planar member 22 by one or more spot welds at locations where the two members are in mutual abutment. As shown in FIG. 14 these locations may include a region within the through-bore 21 as well as within a region to the side of the graphite pad 11 remote from the carbon fibre strip 2.

In addition to the provision of spot welds the first and second members 22 and 24 may be compressed into the graphite pad 11 so as to ensure a reliable electrical contact and a secure mechanical connection.

Figure 16:
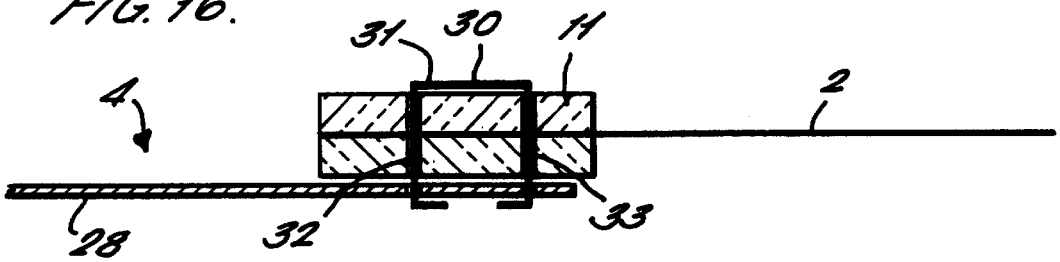
FIG. 16 is a cross-sectional side view of a fifth arrangement whereby the support member of FIG. 6 is attached to an electrical conductor.
Figure 17:
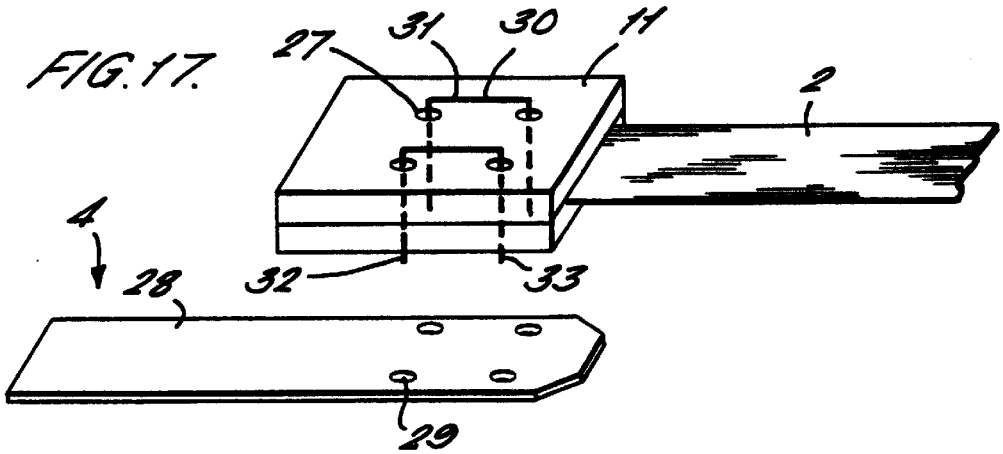
FIG. 17 is an exploded perspective view of the arrangement of FIG. 16.

In another arrangement shown in FIGS. 16 and 17 the graphite pad 11 may be provide with one or more pairs of mutually spaced, parallel through-bores 27 each having a through-axis that extends substantially perpendicularly to the plane of the carbon fibre strip 2. As before the electrical conductor 4 may again comprise a substantially planar molybdenum strip 28 this time having a corresponding number of pairs of mutually spaced through-holes 29.

In this arrangement in order to secure the graphite pad 11 to the electrical conductor 4 the graphite pad is first positioned on the molybdenum strip 28 in such a way that each pair of through-bores 27 is aligned with a corresponding pair of through-holes 29. Thereafter one or more molybdenum staples 30 each comprising a cross piece 31 and a pair of depending legs 32 and 33 are inserted into the graphite pad 11 in such a way that the cross piece 31 overlies a surface of the graphite pad remote from the molybdenum strip 28 while the two depending legs 32 and 33 extend through a respective one of each pair of through-bores 27 and project from the corresponding through holes 29. Thereafter that portion of the depending legs 32 and 33 that project from the through-holes 29 may be folded so as to lie adjacent the molybdenum strip 28. As before, the molybdenum strip and staple 28 and 30 may be compressed into the graphite pad 11 so as to ensure a reliable electrical contact and a secure mechanical connection.

Figure 18:
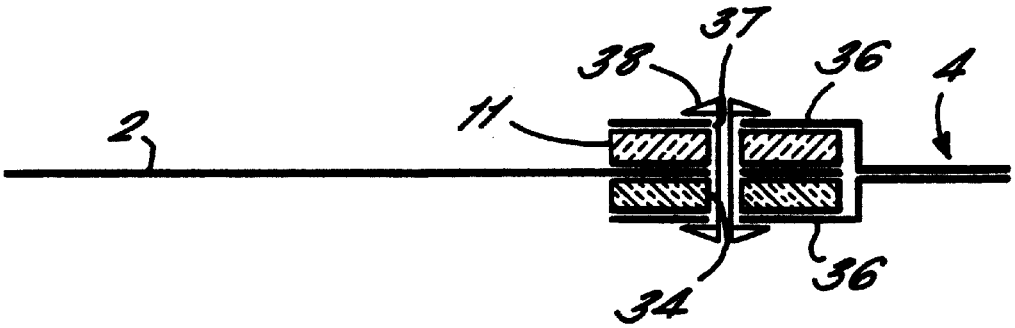
FIG. 18 is a cross-sectional side view of a sixth arrangement whereby the support member of FIG. 6 is attached to an electrical conductor.
Figure 19:
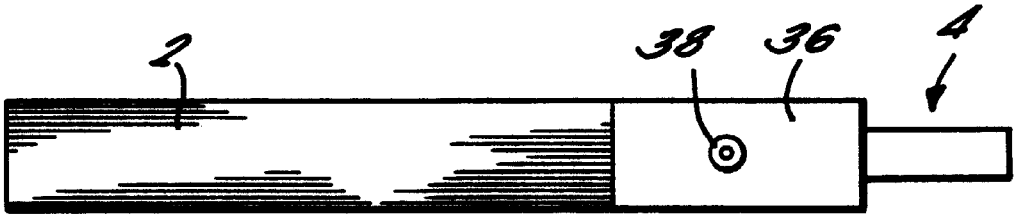
FIG. 19 is a plan view of the arrangement of FIG. 18.

In a another arrangement shown in FIGS. 18 and 19 the graphite pad 11 is again provided with a through-bore 34 having a through-axis that extends substantially perpendicular to the plane of the carbon fibre strip 2. In this arrangement the electrical conductor 4 may comprise a substantially C-shaped molybdenum strip which is so sized as to be capable of receiving the graphite pad 11 between the projecting limbs 36 of the C-shape. Each of these limbs 36 is provided with an opening 37 which, when the graphite pad 11 is received within the C-shaped strip 35, is an alignment with the through-bore 34. Thus once in this position the graphite pad 11 may be secured to the C-shaped strip 35 simply by means of a molybdenum rivet 38.

In all of the foregoing arrangements for attaching the graphite pad 11 to the electrical conductor 4 it is considered preferable not to completely enclose the graphite pad so that the graphite pad may cool radiatively.

The carbon fibres of the strip 2 may be treated either before or after the attachment of the connectors 3 to provide a surface coating of vitreous carbon that bonds the fibres together. In this sense the term vitreous is used to refer to the properties of a material whose atomic constituents are bound, though not so as to form any regular crystalline structure.

The carbon fibres of the strip 2 can be considered to be carbon/carbon composite filaments formed from carbon fibres which have been coated with a layer of carbon-based resin and then pyrolysed in an inert atmosphere at an elevated temperature so that the resin is carbonised in a similar manner to that described in the article by Newling and Walker, published in Plastics and Polymers Conference Supplement Number 5, Paper No. 37, pages 142 to 153 (Publishers: Plastics Institute, London, February 1971), which is the proceedings of a Conference entitled "Carbon Fibres, their Composites and application". The temperature of pyrolysation is typically below 2600° C. The reason for this is that the coating graphitises at a higher temperature reducing the emissivity of the strip 2 as well as changing the mechanical properties of the coating. Thus the strip 2 forms the element of the source and has an emissivity close to unity for all infra-red wavelengths between 1 and 10 microns. This is important to ensure rapid loss of heat on de-energising the electrical power.

This treatment of the carbon fibres which gives rise to the carbon/carbon composite prevents the release of gases and vapours during subsequent operation of the source that might otherwise contaminate the tube 1.

The strip 2 is preferably formed to a uniform thin section having a thickness of between 30 and 400 microns at a central region intermediate the connectors 3 in order to satisfy durability and response time criteria. For a strip thickness of 200 microns, on application of a constant current that would eventually raise the strip temperature to 1000° C. when radiating to a surrounding at ambient temperature, the strip 2 would be heated to a temperature where it is radiating 70% of its final output in three seconds. For a strip at 1000° C. radiating to a surrounding at ambient temperature, on removing the energising current, the strip 2 would cool sufficiently rapidly so as to radiate less than 30% of its initial output in two seconds. The resistivity of a strip 2 formed from carbon fibres coated in this way changes by less than 20% on heating from ambient temperature to 1000° C.

The use of carbon fibres coated with a layer of vitreous carbon provides the conductive element with properties which enable the source to be progressively superior in operation to prior infra-red radiation sources as its thickness is reduced since its response time is also greatly reduced. The additional mechanical stability provided by the coating on the fibres enables the use of an element of such thickness.

Once the respective opposite ends of the electrically conductive element have been attached to each connector 3 and the carbon-based resin of the carbon fibre strip 2 has been carbonised, an infra-red radiation source is assembled by inserting the electrically conductive element and the respective connectors 3 into a quarzglas tube or housing 1. In this process and during subsequent operation the electrically conductive element 2 may be held in position with respect to the tube simply by means of the relative positioning of the connectors 3 whilst a small spring may be provided as part of the electrical conductor 4 to compensate for an expansion of up to 1 mm in the dimensions of element during high temperature operation.

Figure 20:
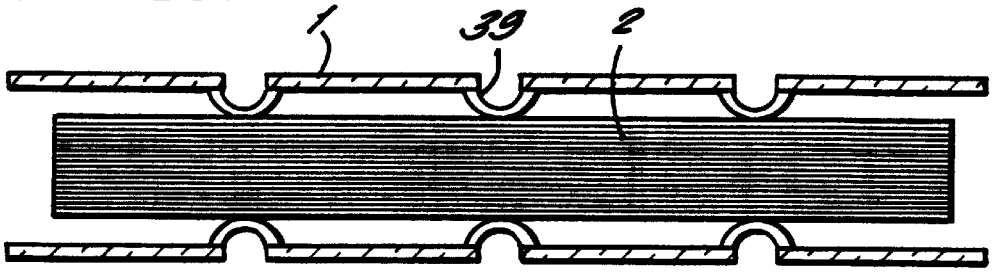
FIG. 20 is a cross-sectional side view of a first arrangement whereby the electrically conductive element may be located with respect to a surrounding tube.
Figure 21:
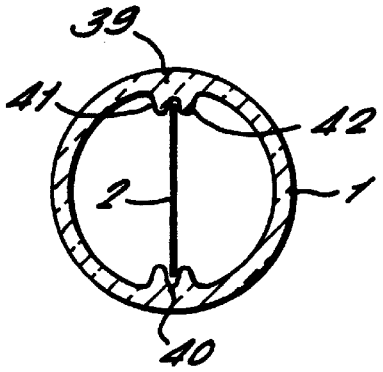
FIG. 21 is a cross-sectional end view of the arrangement of FIG. 20.

In an alternative arrangement shown in FIG. 20 the quarzglas tube 1 may be provided at intervals along its length with a plurality of pairs of diametrically opposed pinches 39. One such pinch is shown in FIG. 21 to comprise an arcuate recess 40 provided in the wall of the tube which is defined by two radially inwardly projecting indentations 41 and 42.

In the arrangement shown in FIG. 20 the carbon fibre strip 2 is mounted with respect to the tube 1 in such a way that the strip and the pinches 39 are substantially co-planar. In this way the carbon fibre strip may be received within the arcuate recess 40 of each of the pairs of diametrically opposed pinches 39. Thus the electrically conductive element may be orientated with respect to the tube 1 and constrained from unwanted lateral or rotational movement whilst at the same time being allowed to expand and contract in a longitudinal direction.

Figure 22:
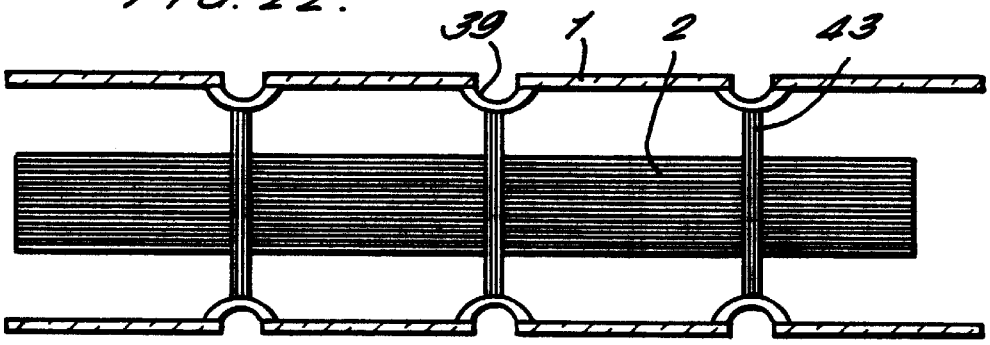
FIG. 22 is a cross-sectional side view of a second arrangement whereby the electrically conductive element may be located with respect to a surrounding tube.
Figure 23:
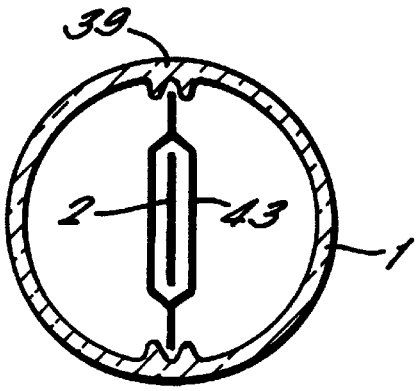
FIG. 23 is a cross-sectional end view of the arrangement of FIG. 22.

In another arrangement shown in FIGS. 22 and 23 the quarzglas tube 1 is again provided at intervals along its length with a plurality of pairs of diametrically opposed pinches 39. However, instead of retaining the electrically conductive element 2 the pinches 39 serve to retain a carbon fibre or graphite paper yoke 43 and it is this yoke that serves to prevent excessive lateral or rotational movement of the electrically conductive element whilst at the same time allowing for expansion of the element in a longitudinal direction.

In such an arrangement the yoke 43 may be formed from graphite paper or resin-impregnated carbon fibre bonded together at a pressure of approximately 6 Kg and at a temperature of between 300 and 400° C. If the yoke 43, is formed of graphite paper, then the yoke may be further supported by a tantalum shim which may not only provide the yoke with an increased rigidity but may also act as an oxygen getter.

It will be apparent to those skilled in the art that whilst the yoke 43 has been illustrated as being received within a number of pairs of diametrically opposed pinches 39 disposed at intervals along the length of the tube 1 this need not necessarily be the case. Indeed, the quarzglas tube need not be provided with any type of formation on its internal surface with which to engage the yoke and instead the yoke may simply act as a spacer to locate the electrically conductive element 2 with respect to the walls of the tube 1.

Figure 24:
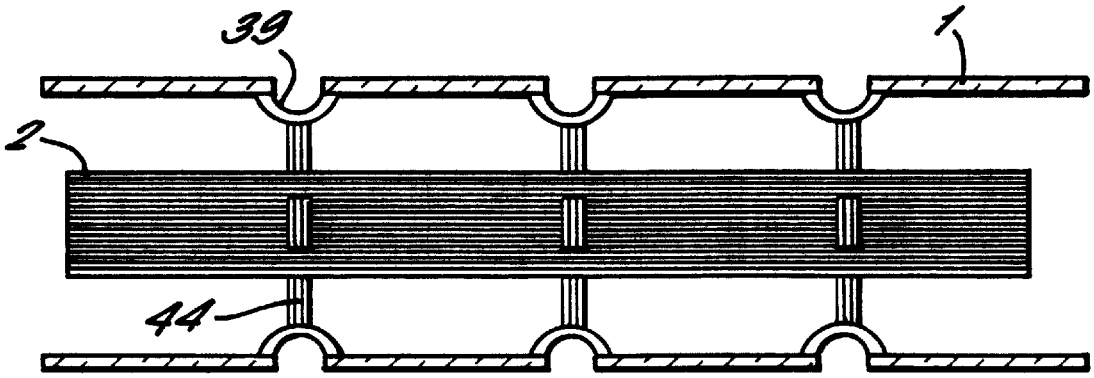
FIG. 24 is a cross-sectional side view of a third arrangement whereby the electrically conductive element may be located with respect to a surrounding tube.
Figure 25:
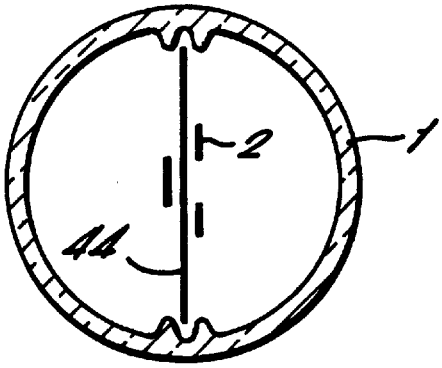
FIG. 25 is a cross-sectional end view of the arrangement of FIG. 24.

In another arrangement shown in FIGS. 24 and 25 a plurality of carbon fibre spacers 44 are woven through the electrically conductive element 2 at intervals along its length in such a way that the spacers extend in a direction substantially co-planar with but tranverse to the electrically conductive element. Each of the carbon fibre spacers 44 is preferably of sufficient length such that its opposite ends are capable of engaging opposing regions on the walls of the quarzglas tube 1. In this way the spacers 44 may simply act to locate the electrically conductive element 2 with respect to the tube 1.

In an alternative arrangement the tube 1 may be provided at intervals along its length with a plurality of pairs of diametrically opposed pinches 39 capable of receiving the opposite ends of the spacers 44. In either case the fact that the electrically conductive element 2 is formed of a plurality of carbon fibres which extend longitudinally of the element means that the element is capable of a slight longitudinal movement with respect to the spacers 44 which can be utilised to allow for contraction and expansion of the element.

Having inserted the electrically conductive element 2, the tube 1 is sealed and can either be filled with a chemically inert gas of low thermal conductivity, such as argon, at sub-atmospheric pressure, or evacuated. In the former case the filling pressure of the gas is chosen so that the infra-red transparent tube 1 is not unduly stressed throughout the operating temperature range of the source while the specific gas that is used is chosen to prevent deterioration of the surface of the carbon fibres of the strip 2 by oxidation and to minimise heat transfer from the strip 2 to the tube 1.

Although the illustrated carbon fibre source has been described as having an infra-red transparent tube 1 which encloses and surrounds the strip 2 in an inert atmosphere or a vacuum, any method of protecting the strip 2 from oxidation may be used. One such method might be the application of a protective coating capable of withstanding the high temperature of operation of the source. One such coating might comprise silicon carbide (SiC). Alternatively the surface of the strip 2 may be doped with boron.

We claim:

1. An infra-red radiation source comprising a housing formed of a material transparent to infra-red radiation; an electrically conductive element disposed within said housing and formed of a plurality of carbon fibers; and connection means for connecting the electrically conductive element across an electrical power supply, said connection means including at least one support member formed of carbon and secured to one end of the electrically conductive element, each support member comprising a plurality of layers of carbon fiber which are laid one on top of the other and bonded to the electrically conductive element.

2. An infra-red radiation source as claimed in claim 1, wherein the electrically conductive element is protected from oxidation by a protective coating.

3. An infra-red radiation source as claimed in claim 2, wherein said conductive element is coated with a vitreous carbon coating.

4. An infra-red radiation source as claimed in claim 1, wherein the carbon fibers of the electrically conductive element are held in a carbonized matrix.

5. An infra-red radiation source as claimed in claim 1, wherein the carbon fibers of the electrically conductive element are coated with a carbon based resin pyrolized at a temperature of less than 2,600° C.

6. An infra-red radiation source as claimed in claim 1, wherein the electrically conductive element is formed from a substantially flat strip.

7. An infra-red radiation source as claimed in claim 6, wherein a region intermediate the ends of the strip has a thickness of less than 400 microns.

8. An infra-red radiation source as claimed in claim 6, wherein the strip is wound so as to form a spiral.

9. An infra-red radiation source as claimed in claim 1, wherein the carbon fibers of each of said plurality of layers are coated with a carbon-based resin and the layers are bonded to each other and to the electrically conductive element by the carbonizing of said resin on heating.

10. An infra-red radiation source as claimed in claim 1, wherein said connection means includes a respective conducting member connected to each support member, the conducting member being formed of a non-ferrous metal.

11. An infra-red radiation source as claimed in claim 1, wherein said connection means includes a respective conducting member which is formed about each support member and compressed so as to retain the support member with respect to the conducting member and establish electrical contact therebetween.

12. An infra-red radiation source in accordance with claim 10, wherein the conducting member is connected to the support member by means of the inter-engagement of one or more pairs of formations provided on said members.

13. An infra-red radiation source as claimed in claim 12, wherein one of said pairs of inter-engaging formations comprise a through-bore provided in the support member and a projecting portion provided on the conducting member and adapted for receipt within said through-bore.

14. An infra-red radiation source as claimed in claim 13, wherein a distal end of said projecting portion projects from said through-bore and is angled so as to retain the support member with respect to the conducting member.

15. An infra-red radiation source as claimed in claim 10, wherein the conducting member comprise two or more elements disposed about the support member, the conducting member being connected to the support member by the joining of said elements in such a way as to retain the support member therebetween.

16. An infra-red radiation source as claimed in claim 15, wherein said elements are joined by welding.

17. An infra-red radiation source as claimed in claim 15, wherein said elements are joined by one or more rivets.

18. An infra-red radiation source as claimed in claim 10, wherein the respective conducting member is connected to each support member by means of one or more staples.

19. An infra-red radiation source as claimed in claim 10, wherein the conducting member is formed of molybdenum.

20. An infra-red radiation source comprising a housing formed of a material transparent to infra-red radiation; an electrically conductive element disposed within said housing and formed of a plurality of carbon fibers; and connection means for connecting the electrically conductive element across an electrical power supply, said connection means including at leat one support member secured to one end of the eletrically conductive element and formed of or coated with a metal through which carbon does not diffuse, said one end of the electrically conductive element and a portion of the support member in contact with the electrically conductive element being coated or alloyed with a material that wets the surface of both said one end and said portion of the support member and provides electrical contact between the two.

21. An infra-red radiation source as claimed in claim 20, wherein the support member is formed of or coated with copper.

22. An infra-red radiation source as claimed in claim 20, wherein said meterial that wets is gold.

23. An infra-red radiation source as claimed in claim 20, wherein said material tht wets is chromium.

24. An infra-red radiation source comprising a housing formed of a material transparent to infra-red radiation, an electrically conductive element located within the housing and formed of a plurality of carbon fibers, connection means for connecting the electrically conductive element across an electrical power supply and restraining means for limiting unwanted movement of the conductive element with respect to the housing, said restraining means including one or more formations provided on an internal surface of the housing.

25. An infra-red radiation source as claimed in claim 24, wherein the formations comprise one or more pairs of diametrically opposed pinches.

26. An infra-red radiation source as claimed in claim 24, wherein said unwanted movement is limited by the engagement of the electrically conductive element with the formations.

27. An infra-red radiation source as claimed in claim 24, wherein said restraining means include a yoke and said unwanted movement is limited by the engagement of the electrically conductive element with the yoke.

28. An infra-red radiation source as claimed in claim 27, wherein the yoke is constrained with respect to the housing by engagement with the formations.

29. An infra-red radiation source as claimed in claim 27, wherein the yoke is formed of a plurality of carbon fibers.

30. An infra-red radiation source as claimed in claim 27, wherein the yoke is formed of graphite paper.

31. An infra-red radiation source as claimed in claim 27, wherein the yoke includes a tantalum shim.

32. An infra-red radiation source as claimed in claim 24, wherein said restraining means includes one or more carbon fiber spacers.

33. An infra-red radiation source as claimed in claim 32, wherein said carbon fiber spacers are woven through the electrically conductive element and extend in a direction generally transverse thereto.

34. An infra-red radiation source as claimed in claim 32, wherein said carbon fiber spacers are constrained with respect to the housing by engagement with the formations.

35. An infra-red radiation source as claimed in claim 24. wherein said housing is filled with a chemically inert and thermally insulating gas.

36. An infra-red radiation source as claimed in claim 35, wherein said gas is at sub-atmospheric pressure.

37. An infra-red radiation source as claimed in claim 24, wherein said housing is sealed and evacuated.

38. A method of making an infra-red radiation source comprising the steps of forming an electrically conductive element from a plurality of carbon fibers, disposing the electrically conductive element within a housing formed of a material transparent to infra-red radiation, the housing having one or more formations on an internal surface thereof providing the electrically conductive element with means to limit unwanted movement of the electrically conductive element with respect to the housing by engaging the electrically conductive element or one or more members with which the electrically conductive element is itself engaged, with said formations, and securing to the electrically conductive element means for connecting the electrically conductive element across an electrical power supply.

39. A method as claimed in claim 38, wherein said step of providing the electrically conductive element with means to limit unwanted movement of the electrically conductive element with respect to the housing comprises forming a yoke and locating the electrically conductive element with respect to said yoke.

40. A method as claimed in claim 38, wherein said step of providing the electrically conductive element with means to limit unwanted movement of the electrically conductive element with respect to the housing comprises forming one or more spacers of carbon fiber and weaving the or each spacer through the electrically conductive element so as to extend in a direction substantially transverse thereto.

* * * * *

UNITED STATES PATENT AND TRADEMARK OFFICE

CERTIFICATE OF CORRECTION

PATENT NO. : 6,057,532

DATED : May 2, 2000

INVENTOR(S) : Amos Christopher Dexter et al.

It is certified that error appears in the above-identified patent and that said Letters Patent is hereby corrected as shown below:

On the Title Page

Add Section [73] Assignee: EA Technology Limited
Chester,
United Kingdom

Column 10, line 37, cancel "leat" and insert --least--.

Signed and Sealed this

Twenty-second Day of May, 2001

*Attest:*

Nicholas P. Godici

NICHOLAS P. GODICI

*Attesting Officer*

*Acting Director of the United States Patent and Trademark Office*